US007883434B2

(12) United States Patent
Davis et al.

(10) Patent No.: US 7,883,434 B2
(45) **Date of Patent: *Feb. 8, 2011**

(54) COMPOSITE BAT HAVING A MULTIPLE TUBE STRUCTURE

(75) Inventors: Stephen J. Davis, Newton, PA (US); Roberto Gazzara, Mestre (IT); Mauro Pinaffo, Composampiero (IT); Michele Pozzobon, Fossalunga di Vedalago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/509,999

(22) Filed: Aug. 26, 2006

(65) Prior Publication Data

US 2008/0051230 A1 Feb. 28, 2008

(51) Int. Cl.
*A63B 59/06* (2006.01)

(52) U.S. Cl. ..... 473/567; 473/566

(58) Field of Classification Search ..... 473/560–568, 473/549–551, 519, 520, 457, 316
See application file for complete search history.

(56) References Cited

U.S. PATENT DOCUMENTS

| | | | | |
|---|---|---|---|---|
| 59,313 | A | 10/1866 | Hill | |
| 729,639 | A | 6/1903 | McCoy | |
| 1,025,478 | A | 5/1912 | Murphy | |
| 1,530,427 | A | 3/1925 | Simon | |
| 2,033,722 | A | 3/1936 | MacFarland | |
| 2,321,773 | A | 6/1943 | Rumelin | |
| 3,377,066 | A | 4/1968 | Trowbridge | |
| 3,392,976 | A | 7/1968 | Hayes | |
| 4,086,115 | A | 4/1978 | Sweet | |
| 4,124,208 | A | 11/1978 | Burns | |
| 4,264,389 | A | 4/1981 | Staub | |
| 4,358,113 | A | 11/1982 | McKinnon | |
| 4,600,193 | A * | 7/1986 | Merritt | 473/566 |
| 4,795,153 | A * | 1/1989 | Thomas | 473/316 |
| 4,931,247 | A | 6/1990 | Yeh | |
| 5,082,279 | A | 1/1992 | Hull | |
| 5,097,870 | A * | 3/1992 | Williams | 138/115 |
| 5,153,798 | A | 10/1992 | Ruigrok | |
| 5,179,255 | A | 1/1993 | Yeh | |
| 5,249,846 | A | 10/1993 | Martin | |
| 5,285,008 | A | 2/1994 | Sas-Jaworsky | |
| 5,297,791 | A | 3/1994 | Negishi | |

(Continued)

FOREIGN PATENT DOCUMENTS

| | | |
|---|---|---|
| CA | 2154370 | 3/1997 |

(Continued)

OTHER PUBLICATIONS

U.S. Appl. No. 11/636,294, filed Dec. 8, 2006, Gazzara et al.

(Continued)

*Primary Examiner*—Mark S Graham
(74) *Attorney, Agent, or Firm*—Abelman, Frayne & Schwab

(57) ABSTRACT

A structure for a bat is described by using multiple composite tubes bonded to one another, wherein apertures, or "ports," are molded between the tubes to improve the stiffness, strength, aerodynamics and comfort of the bat.

21 Claims, 6 Drawing Sheets

U.S. PATENT DOCUMENTS

| | | | | |
|---|---|---|---|---|
| 5,301,940 | A | 4/1994 | Seki | |
| 5,303,916 | A | 4/1994 | Rodgers | |
| 5,419,553 | A | 5/1995 | Rodgors | |
| 5,614,305 | A | 3/1997 | Paine | |
| 5,636,836 | A | 6/1997 | Carroll | |
| 5,746,955 | A | 5/1998 | Calapp | |
| 5,766,104 | A | 6/1998 | Albarelli | |
| 5,865,696 | A | 2/1999 | Calapp | |
| 5,879,250 | A | 3/1999 | Tahtinen | |
| 5,975,645 | A | 11/1999 | Sargent | |
| 6,042,493 | A | 3/2000 | Chauvin | |
| 6,086,161 | A | 7/2000 | Luttgeharm | |
| 6,113,508 | A | 9/2000 | Locarno | |
| 6,129,962 | A | 10/2000 | Quigley | |
| 6,241,633 | B1 | 6/2001 | Conroy | |
| 6,383,101 | B2 | 5/2002 | Eggiman et al. | |
| 6,485,382 | B1 | 11/2002 | Chen | |
| 6,663,517 | B2 | 12/2003 | Buiatti et al. | |
| 6,723,012 | B1 | 4/2004 | Sutherland | |
| 6,761,653 | B1 | 7/2004 | Higginbotham et al. | |
| 6,764,419 | B1 | 7/2004 | Giannetti et al. | |
| 6,776,735 | B1 | 8/2004 | Belanger et al. | |
| 6,800,239 | B2 | 10/2004 | Davis | |
| 6,808,464 | B1 | 10/2004 | Nguyen | |
| 6,866,598 | B2 | 3/2005 | Giannetti et al. | |
| 6,872,156 | B2 | 3/2005 | Ogawa et al. | |
| 7,014,580 | B2 * | 3/2006 | Forsythe et al. | 473/566 |
| 7,207,907 | B2 * | 4/2007 | Guenther et al. | 473/566 |
| 7,309,299 | B2 | 12/2007 | Pezzato | |
| 7,396,303 | B2 | 7/2008 | Gazzara | |
| 2003/0104152 | A1 * | 6/2003 | Sommer | 428/36.91 |
| 2003/0162613 | A1 | 8/2003 | Davis | |
| 2004/0048683 | A1 | 3/2004 | Burrows | |
| 2004/0198538 | A1 | 10/2004 | Goldsmith | |
| 2004/0198539 | A1 * | 10/2004 | Sutherland et al. | 473/567 |
| 2005/0062337 | A1 | 3/2005 | Meggiolan | |
| 2005/0153799 | A1 * | 7/2005 | Rigoli | 473/513 |
| 2005/0164814 | A1 | 7/2005 | Tucker | |
| 2005/0221924 | A1 * | 10/2005 | Sutherland et al. | 473/564 |
| 2006/0122013 | A1 | 6/2006 | Dodge | |
| 2006/0172828 | A1 | 8/2006 | Pezzato et al. | |
| 2006/0247077 | A1 * | 11/2006 | Deetz | 473/513 |
| 2007/0123376 | A1 | 5/2007 | Gazzara | |
| 2007/0135245 | A1 | 6/2007 | Gazzara | |
| 2007/0200422 | A1 | 8/2007 | Davis | |
| 2007/0222178 | A1 | 9/2007 | Davis | |
| 2007/0238560 | A1 | 10/2007 | Gazzara | |
| 2007/0293344 | A1 | 12/2007 | Davis | |

FOREIGN PATENT DOCUMENTS

| | | | |
|---|---|---|---|
| CA | 2231908 | | 9/1999 |
| DE | 4415509 | | 11/1995 |
| EP | 1859838 | | 11/2007 |
| EP | 1859839 | | 11/2007 |
| JP | 53038431 | | 4/1978 |
| JP | 02255164 | A * | 10/1990 |
| JP | 05015624 | A * | 1/1993 |
| JP | 09117968 | | 5/1997 |
| JP | 11276652 | A * | 10/1999 |
| JP | 2000042155 | A * | 2/2000 |
| WO | WO 84/03447 | | 9/1984 |
| WO | WO 94/26361 | | 11/1994 |
| WO | WO 00/09219 | | 2/2000 |
| WO | WO 01/26752 | | 4/2001 |
| WO | WO 03/076176 | | 9/2003 |
| WO | WO 2004/075996 | | 9/2004 |

OTHER PUBLICATIONS

U.S. Appl. No. 11/636,314, filed Dec. 8, 2006, Gazzara et al.
U.S. Appl. No. 11/524,990, filed Sep. 20, 2006, Stephen J. Davis.
U.S. Appl. No. 11/752,574, filed May 23, 2007, Stephen J. Davis.
US 7,223,188, 05/2007, Davis (withdrawn)

* cited by examiner

COMPOSITE BAT HAVING A MULTIPLE TUBE STRUCTURE

BACKGROUND OF THE INVENTION

The present invention relates to a composite structure for a bat.

The performance of a baseball or softball bat is determined by a number of factors such as weight, swing weight, ball rebound velocity, strength, and aerodynamics. The traditional metal or composite material bat is a single tubular structure with a hitting portion, a gripping portion, and a tapered portion connecting the two. The wall thickness can vary along its length to provide specific performance needs. The bat may be made from a number of materials such as aluminum, steel, titanium, and light weight composite materials.

The weight of a bat is a critical feature in determining performance. The lighter the bat weight, the easier it is to swing the bat resulting in higher swing speeds. Therefore, the lightest materials and designs are used to achieve these performance goals. The most popular high performance material for modern bat design is carbon fiber reinforced epoxy resin (CFE) because it has the highest strength and stiffness-to-weight ratio of any realistically affordable material. As a result, CFE can produce a very light weight bat with excellent strength as well as providing a variety of stiffnesses.

Another very important characteristic is how the ball rebounds off the face of the bat. A desired characteristic is to have the face of the bat deform and return during ball contact to increase the rebound velocity or coefficient of restitution (COR). This can be accomplished by producing the bat as a hollow structure, with the walls of the bat produced using a light weight metal or fiber reinforced composite material. However, care should be taken not to make the walls too thin and weak, because considerable hoop stress exists when the bat contacts the ball.

Another desirable feature in a bat is comfort. Striking the ball off the center region or "sweet spot" of the bat can be a painful experience due to the resulting torque (shock) and vibrations transmitted to the hands. All types of shock and vibration are magnified with a bat of a lighter weight, which doesn't have the sufficient mass or inertia to absorb the shock or damp the vibrations.

Another desirable feature in a bat is aerodynamics. However, aerodynamics have not been seriously considered in the past because most bats are restricted by their external geometry and bat diameter which determines aerodynamic drag.

The evolution of the modern bat over the past twenty years has focused on light weight, improving ball rebound velocity, comfort, improving strength, and aerodynamics. However, there has not been a bat that has all of the mentioned performance benefits.

An example of producing a bat out of light weight composite materials is U.S. Pat. No. 4,931,247 to Yeh who discloses a process of rolling up sheets of fibers impregnated with resin and placing in a mold and internally inflating using a bladder. This created a light weight product which was easier to swing.

A design to increase the Coefficient of Restitution (COR) of a bat is shown by U.S. Pat. No. 6,872,156 to Ogawa, et. al., who describes a bat with an exterior elastic sleeve in the hitting portion of the bat to improve ball rebound velocity. Other examples are U.S. Pat. Nos. 6,764,419 and 6,866,598 to Giannetti et. al., and U.S. Pat. No. to Buiatti, et. al., who describe a bat with a thin cylindrical outer wall, an internal cylindrical inner wall with material in between to improve the ball rebound velocity and to improve strength.

U.S. Pat. No. 6,808,464 to Nguyen discloses an improvement to the comfort of a composite bat by using elastomeric caps at the end of outer walls and internal walls to create a wood like feel and damp vibrations.

U.S. Pat. No. 6,383,101 to Eggiman, et. al., describes an insert or sleeve of a fiber reinforced composite material with fibers aligned circumferentially to obtain improved strength. Other examples of using composite materials to improve strength are disclosed by U.S. Pat. No. 6,723,012 to Sutherland who uses a three-dimensional fiber reinforcement architecture to improve durability, and U.S. Pat. No. 6,776,735 to Belanger, et. al., who use continuous fibers embedded in a resin to achieve superior strength over the traditional wood bats. Also, U.S. Pat. No. 6,761,653 to Higginbotham, et. al. combines a metal bat with an exterior fiber reinforced composite shell to improve strength.

There exists a continuing need for an improved bat system. In this regard, the present invention substantially fulfills this need.

SUMMARY OF THE INVENTION

The present invention relates to a composite structure for a bat, and more particularly, where the structure is generally tubular and the traditional single tube is replaced with multiple continuous tubes, preferably a pair of tubes fused together along their facing surfaces to provide an internal reinforcing wall as well as apertures, or "ports," between the tubes to provide specific performance advantages.

In particular, the basis of the design is to replace a single tube portion with a double tube design while maintaining the same or similar geometric exterior shape of the original single circular tube design. This provides a structure with an internal wall between the tubes which has strength and stiffness advantages. In addition, the tubes can be separated at various locations to form apertures or ports between the tubes which act as opposing arches which provide advantages in strength, stiffness, comfort, and aerodynamics.

The bat system according to the present invention substantially departs from the conventional concepts and designs of the prior art and in doing so provides an apparatus primarily developed for the purpose of improved strength, stiffness, comfort, aerodynamics, and appearance.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The present invention provides a new and improved bat system which may be easily and efficiently manufactured.

The present invention provides a new and improved bat system which is of durable and reliable construction.

The present invention provides a new and improved bat system which may be manufactured at a low cost with regard to both materials and labor The present invention further provides a bat system that can provide specific stiffness zones at various orientations and locations along the length of the bat.

The present invention provides an improved bat system that has superior strength and fatigue resistance.

The present invention provides an improved bat system that has improved shock absorption and vibration damping characteristics.

The present invention provides an improved bat system that has improved aerodynamics.

The present invention provides an improved bat system that has a unique look and improved aesthetics.

Lastly, the present invention provides a new and improved bat system made with a multiple tube design, where the tubes, which are fused together along much of their lengths, are preferably separated from one another at selected locations to form apertures that act as double opposing arches, providing improved means of adjusting stiffness, resiliency, strength, comfort, and aerodynamics.

For a better understanding of the invention and its advantages, reference should be made to the accompanying drawings and descriptive matter in which there are illustrated preferred embodiments of the invention.

BRIEF DESCRIPTION OF THE DRAWINGS

The same reference numerals refer to the same parts throughout the various Figures.

DETAILED DESCRIPTION OF THE INVENTION

As described below, the bat is formed of two or more tubes which are molded together to form a common wall (or walls, in the case of more than two tubes). However, at selected locations, the facing surfaces of the tubes are kept apart during molding, to form openings. On either side of the openings, the tubes are joined together. The openings so formed are referred to herein as "ports." These ports are formed without drilling any holes or severing any reinforcement fibers.

The resulting structure is found to have superior performance characteristics for several reasons. The ports are in the shape of double opposing arches which allow the structure to deflect which deforms the ports, and return with more resiliency. The ports also allow greater bending flexibility than would traditionally be achieved in a single tube design. The internal wall between the internal tubes adds strength to resist compressive buckling loads such as those near the hosel of the club head. The structure can also improve comfort by absorbing shock and damping vibrations due to the deformation of the ports. Finally, the ports can improve aerodynamics by allowing air to pass through the bat to reduce the wind resistance and improve maneuverability.

Figure 1:
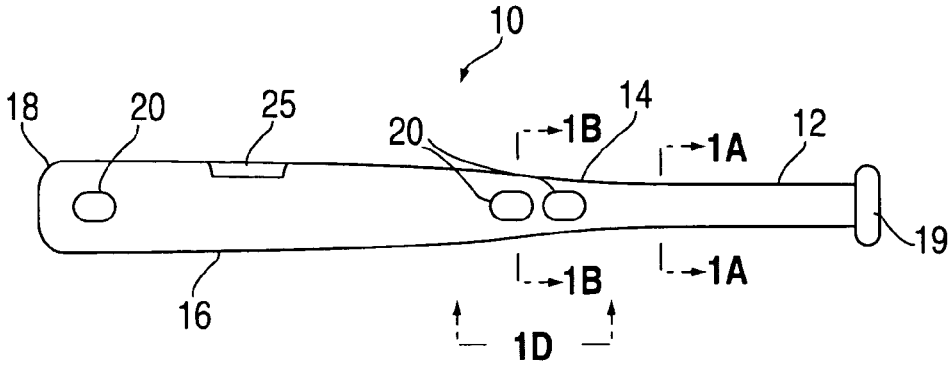
FIG. 1 is a side view of a bat constructed in accordance with an embodiment of the present invention.

FIG. 1 illustrates a bat, which is referred to generally by the reference numeral 10. The bat 10 is comprised of a handle portion 12, a tapered portion 14, a hitting portion 16, a tip end 18, and a butt end 19.

FIG. 1 shows one preferred embodiment wherein the bat 10 contains openings, or "ports" 20, oriented in line and with axes parallel to the direction of swing. Ports oriented in this manner provide improved aerodynamics by reducing the exposed frontal area of the bat to the wind as the bat is swung. The ports 20 can be located anywhere along the length of the bat. FIG. 1 shows ports only in the tapered region 14 and the tip end 18, leaving the hitting portion 16 void of ports. However, if desired, ports could be located in the hitting portion 16 and the handle portion 12.

Figure 1A:
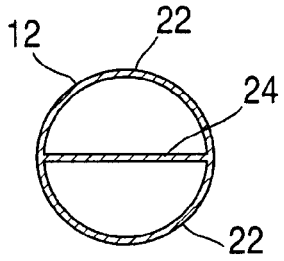
FIG. 1A is a cross sectional view of the bat taken along lines 1A-1A of FIG. 1.

With reference to FIG. 1A, this cross sectional view along the lines 1A-1A of FIG. 1 shows the two tubes 22 which form the structure of the bat. The tubes 22 are joined together to form an internal wall 24 which is preferably oriented so as to be parallel to the direction in which the bat is to be swing. The batter may orient the bat so that the internal wall 24 faces the direction of swing based on the direction of the ports. Alternately, the bat may include a label 25 on the upper surface, or some other type of indicator, so that the user knows how to orient the bat when it is gripped.

The preferred location of the internal wall 24 is near the neutral axis of the bat. Each of the internal tubes 22 should be about the same size and, when molded, form a "D" shape.

Figure 1C:
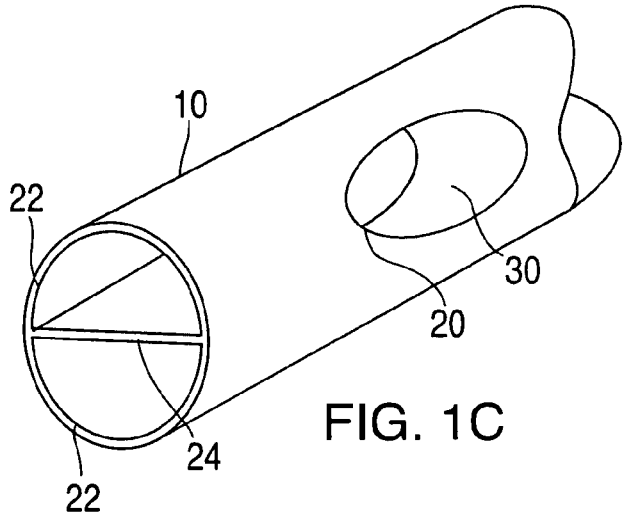
FIG. 1C is an isometric cut away view of a portion of the bat shown in FIG. 1.
Figure 1B:
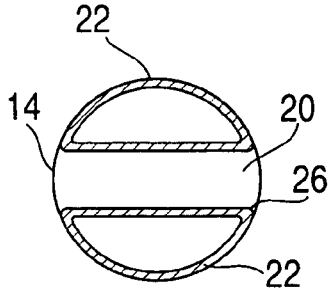
FIG. 1B is a cross sectional view of the bat taken along lines 1B-1B of FIG. 1.

FIG. 1B shows a cross sectional view along the lines 1B-1B of FIG. 1 where the internal tubes 22 are separated from one another to form port 20. It is advisable to have a radius (i.e., rounded edges 26) leading into the port so to reduce the stress concentration and to facilitate the molding process.

FIG. 1C is an isometric view of the bat 10 isolated to one port which shows the two internal tubes 22 and internal wall 24. Also shown is the port 20 and cylindrical wall 30. In this particular example, the axis of the port is 90 degrees to the axis of the tube.

Figure 1D:
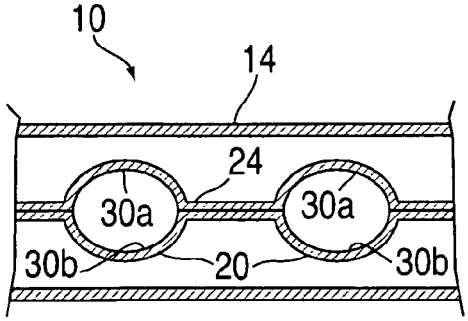
FIG. 1D is a longitudinal sectional view of a portion of the bat taken along lines 1D-1D in FIG. 1.

FIG. 1D is a cross section of a portion of the bat 10 taken along the lines 1D-1D in FIG. 1. The internal tubes 22 are positioned side by side and are fused together along much of their lengths to form a common wall 24. At selected locations, e.g., where ports 20 are to be formed, the facing surfaces 30*a* and 30*b* of the tubes 22 are separated during molding to form apertures 20 in the shape of double opposing arches which act as geometric supports to allow deformation and return. In addition, the internal wall 24 provides structural reinforcement to resist deformations and buckling failures.

Figure 2:
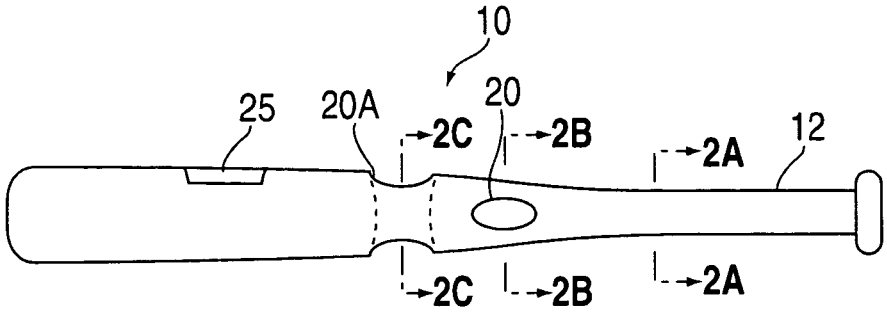
FIG. 2 is a side view of another bat constructed in with a multiple tube design.

An alternative embodiment is to orient the ports so the axes are perpendicular to the direction of travel of the bat. As shown in FIG. 2, the port 20*a* oriented in this manner provides the means to achieve more flexibility of the bat because the double arch structure can provide more bending in this direction due to the reduced shaft section dimension either side of the ports. This can provide more comfort for the batter. In this embodiment the bat 10 is designed using a multiple tube construction with allows for port 20 and port 20*a* to be oriented at different angles. In this particular example, the port 20 near the handle portion 12 provides improved aerodynamics, and the port 20*a* near the hitting portion 16 provides improved flexibility and shock absorption.

Figure 2A:
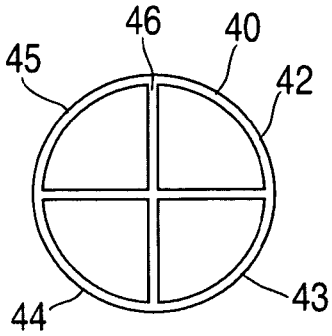
FIG. 2A is a cross section of the bat in FIG. 2 taken along lines 2A-2A.

FIG. 2A is a cross sectional view of the bat 10 taken along the lines 2A-2A in FIG. 2. In this example, 4 tubes (42,43, 44,45) are used to create the tubular part with creates an internal wall 46 in the form of an "X".

Figure 2B:
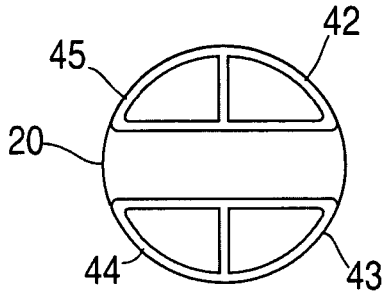
FIG. 2B is a cross section of the bat in FIG. 2 taken along lines 2B-2B.

FIG. 2B is a cross sectional view of the shaft 10 taken along the lines 2B-2B of FIG. 2. This is in the region of port 20 which is oriented parallel to the direction of travel of the bat 10. In this example the internal tubes 42 and 45 have remained together as well as internal tubes 43 and 44.

Figure 2C:
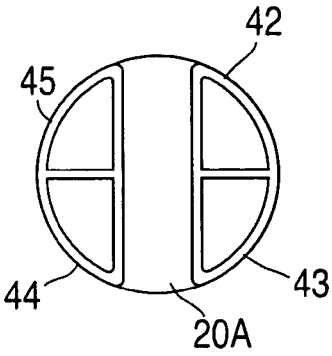
FIG. 2C is a cross section of the bat in FIG. 2, taken along lines 2C-2C.

FIG. 2C is a cross sectional view of the shaft 10 taken along the lines 2C-2C of FIG. 2. This is in the region of port 20*a* which is oriented perpendicular to the direction of travel of the bat 10. In this example the internal tubes 42 and 45 have remained together as well as internal tubes 43 and 44.

Figure 2D:
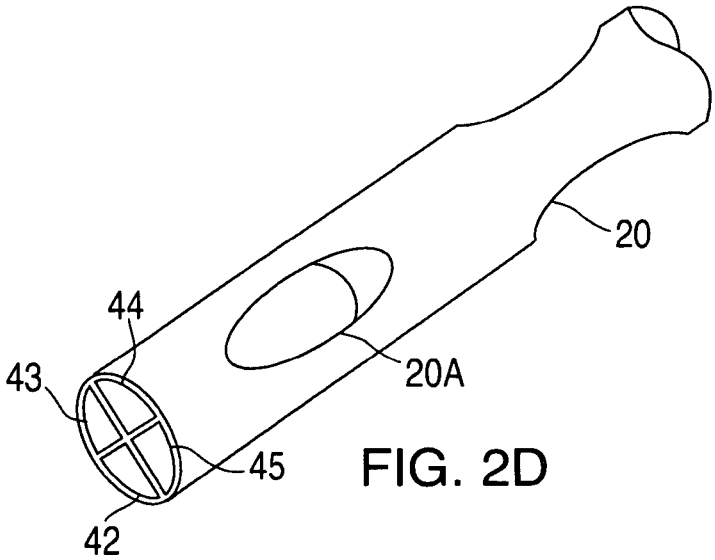
FIG. 2D is an isometric cutaway view of a portion of the bat shown in FIG. 2.

FIG. 2D is an isometric view of a cutaway portion of the bat 10 of FIG. 2 showing port 20 oriented parallel to the direction of travel of bat 10, and port 20*a* oriented perpendicular to the direction of travel of bat 10. As described above in connection with FIGS. 2A and 2B, ports may be formed by separating two tubes from the other two tubes. In this example, to form port 20, internal tubes 42 and 45 have remained together as well as internal tubes 43 and 44. To form port 20*a*, internal tubes 44 and 45 have remained together as well as internal tubes 42 and 43.

Figure 3:
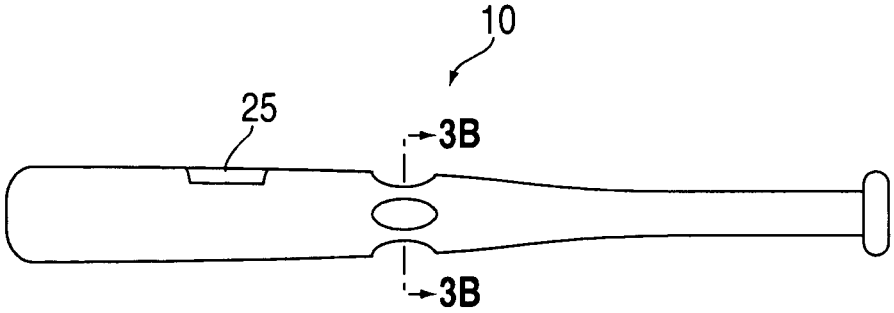
FIG. 3 shows an alternative example of how multiple ports could be oriented in a multiple tube construction

FIG. 3 is a side view of bat 10 with ports for all tubes located in the same location. This can be accomplished with a four tube construction.

Figure 3A:
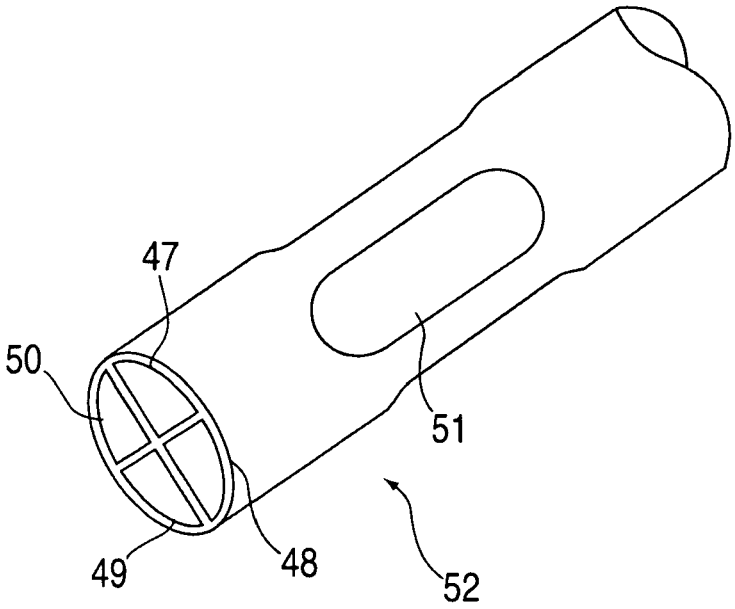
FIG. 3A is an isometric view of a section of the bat of FIG. 3.

FIG. 3A is an isometric cutaway view of the four tube structure 52 with ports for all tubes located in the same location. In this example, internal tubes 47, 48, 49, and 50 are all separated in the same location to form four ports 51 there between.

Figure 3B:
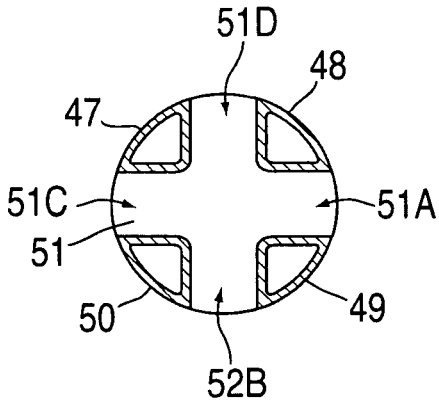
FIG. 3B is a cross sectional view along the lines 3A-3A of FIG. 3.

FIG. 3B is a cross sectional view of the tube structure 52 in FIG. 3 taken along the lines 3B-3B. Here it can be seen that because all internal tubes are separated, there results in an open port 51 that is open on four sides 51*a*, 51*b*, 51*c*, 51*d*. This particular embodiment could provide more flexibility and improved aerodynamics at the same location.

Figure 7A:
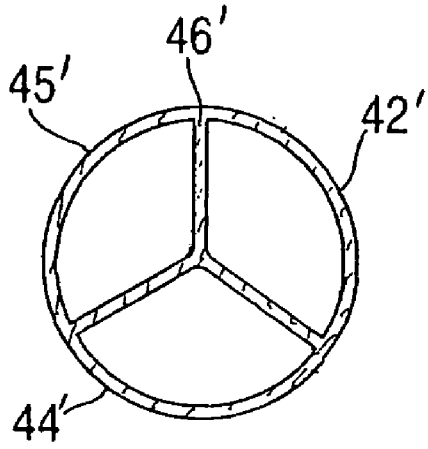
FIG. 7*a* is a cross-sectional view, comparable to the view of FIG. 2A, of a bat formed of three tubes.
Figure 7B:
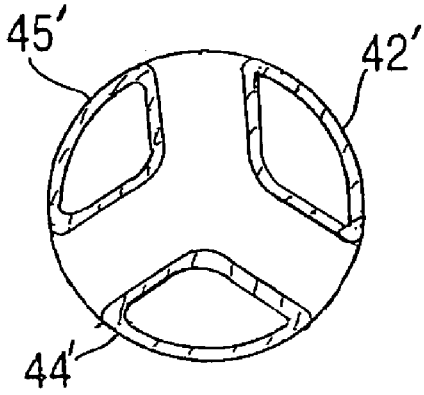
FIG. 7*b* is a cross-sectional view, comparable to the view of FIG. 3B, of a bat formed of three tubes.

FIG. 7A shows a bat formed of three tubes 42', 44', and 45' at a location corresponding to FIG. 2*a*. As shown, the walls of the adjoining tubes fuse to form a common, interior wall 46. FIG. 7 shows the bat at a location corresponding to FIG. 3B. There, as shown, the tubes 42', 44', and 45' are separated from one another to form three ports through the bat structure.

In a multiple tube design, there can be any number of ports and orientations of ports depending on the number of internal tubes used and how many are separated to form these ports. In addition, for example with a 3 tube design, the axis of the port would not necessarily have to pass through the center of the bat.

Figure 4:
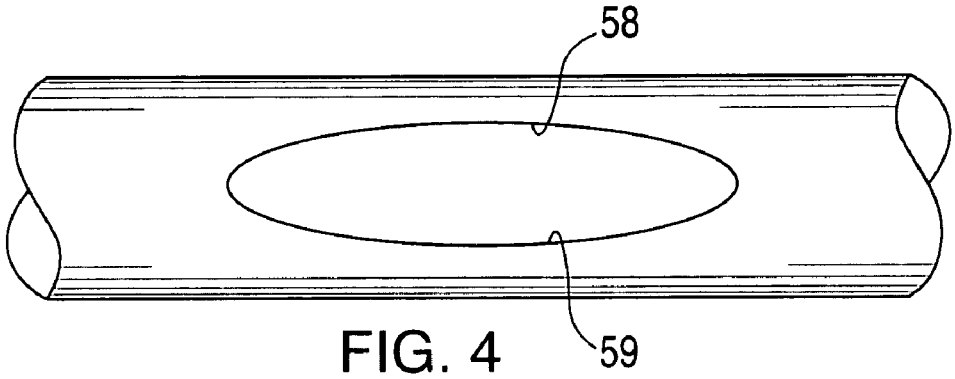
FIG. 4 shows various shapes of ports.
Figure 4A:
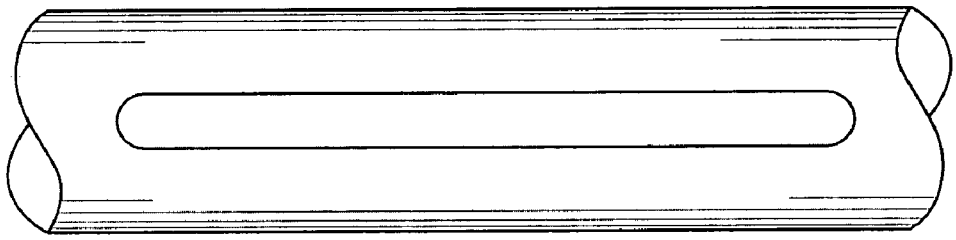
Figure 4B:
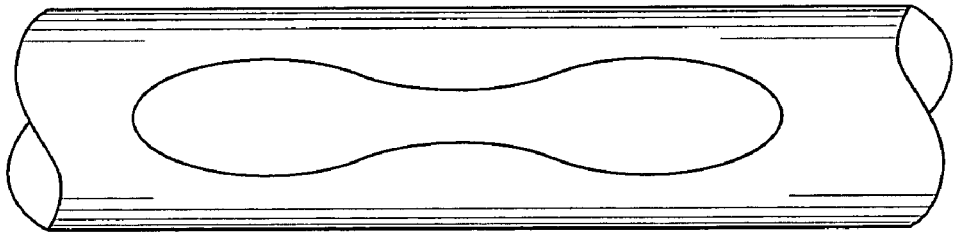
Figure 4C:
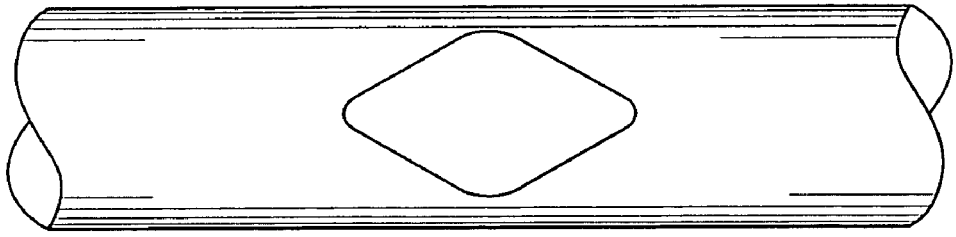

FIG. 4 illustrates some examples of the variety of shapes possible to be used for the ports. Depending on the performance required of the structure at a particular location, more decorative port shapes can be used.

In all orientations, the quantity, size, and spacing of the ports can vary according to the performance desired. In addition, ports can be located in the handle portion and fitted with elastomeric inserts to provide additional cushioning, or wrapped with a perforated grip to provide air circulation to aid in keeping the grip dry.

The preferred embodiments of the present invention use multiple continuous composite tubes which are separated to form apertures in the form of double opposing arches at various locations in the bat.

The single tube, hollow bat has been the traditional way to design and manufacture composite bats. This is because originally, the bat was produced using single hollow metal tubes, so it was natural to replace these tubes with a single hollow composite tube.

It also makes sense from an efficiency viewpoint, that the single hollow tube maximizes the stiffness-to-weight ratio, and the strength-to-weight ratio, because the material is displaced away from the central portion of the bat to maximize inertial properties. This has been the traditional bat structure.

When a single hollow tube has a sufficient wall thickness, for example when weight is not critical, the design can sufficiently provide adequate stiffness and strength. However, as mentioned previously, when the wall thickness becomes thin relative to the diameter of the tube, the tubular part is susceptible to the wall buckling under the compressive forces which are always present in bats.

In accordance with the present invention, conventional single hollow tubes forming the bat are replaced with multiple tubes joined with an internal wall in between. The internal wall resists deformation of the cross section under loading which resists the buckling of the wall under compressive forces.

The invention allows the bat to be custom tuned in terms of its stiffness and resiliency by varying, in addition to the geometry of the bat itself, the size, number, orientation and spacing of the ports in the bat.

The process of molding with composite materials facilitates the use of multiple tubes in a structure. The most common method of producing a composite bat is to start with a raw material in sheet form known as "prepreg" which are reinforcing fibers impregnated with a thermoset resin such as epoxy. The resin is in a "B Stage" liquid form which can be readily cured with the application of heat and pressure. The fibers can be woven like a fabric, or unidirectional, and are of the variety of high performance reinforcement fibers such as carbon, aramid, glass, etc. The prepreg material commonly comes in a continuous roll or can be drum wound which produces shorter sheet length segments. The prepreg is cut at various angles to achieve the correct fiber orientation, and these strips are typically overlapped and positioned in a "lay-up" which allows them to be rolled up over a mandrel to form a perform. In order to pressurize and consolidate the prepreg plies, external pressure must be applied. This is commonly done by wrapping a polymer "shrink tape" around the exterior of the preform which will apply pressure upon the application of heat in a curing oven. The mandrel determines the internal geometry of the bat. The thickness of the consolidated laminate plies determines the external geometry of the bat.

An alternative method of molding a composite bat involves using internal pressure to form the composite bat. This process uses a similar perform, which is placed inside a cavity of a mold. A polymeric thin walled bladder is placed inside the rolled perform, and the mold is closed. As the mold heats up, air pressure is applied to the bladder which inflates to apply pressure to the prepreg laminates to consolidate and cure the part.

The present invention will require a similar internal inflation molding technique because the use of multiple tubes and forming ports requires internal pressure to consolidate the prepreg plies. For example when molding the same bat using two prepreg tubes, each tube should be approximately half the size of the single tube. A polymer bladder is inserted into the middle of each prepreg tube and is used to generate internal pressure to consolidate the plies upon the application of heat. The mold packing process consists of taking each prepreg tube and internal bladder and position into a mold cavity and an air fitting is attached to the bladder. The process is repeated for each tube depending on how many are used. Care should be taken for the position of each tube so that the internal wall formed between the tubes is oriented properly, and that pins can be inserted between the tubes in order to form the ports during pressurization. The pins are secured into portions of the mold and are easily removed.

The mold is pressed closed in a heated platen press and air pressure for each tube should be applied simultaneously to retain the size and position of each tube and the formed wall in between. Simultaneously, the tubes will form around the pins to form the ports, and fuse together to form the internal walls at locations between the ports. As the temperature rises in the mold, the viscosity of the epoxy resin decreases and the tubes expand, pressing against each other until expansion is complete and the epoxy resin is cross linked and cured. The mold is then opened, the pins removed, and the part is removed from the mold.

The internal wall of the molded tubular part adds significantly to improving the structural properties of the tubular part. During bending or local deflections resulting from ball impacts, the shape of the bat is maintained much better, eliminating the tendency to buckle the cross section.

The orientation of the wall can be positioned to take advantage of the anisotropy it offers. If more bending flexibility is desired, the wall can be positioned along the neutral axis of bending. If greater stiffness is needed, then the wall can be positioned like an "I Beam" at 90 degrees to the neutral axis to greatly improve the bending stiffness.

Molding the tubular parts using multiple tubes allows greater design options. Separating the internal tubes at selected axial locations along the shaft in order to mold large oval shaped openings between the tubes, allows the characteristics of the bat to be varied as desired.

Molding in of apertures, or ports, at selected locations results in a double opposing arch construction. What is contributing to the structure, is the "double arch effect" of the ports, which are oval in shape creating two opposing arches 58, 59 (see FIG. 4) which allow the tubular part to deflect, while retaining the cross sectional shape of the tube because of the three dimensional wall structure provided by the port. For example, a ported double tube structure has a combination of exterior walls, which are continuous and form the majority of the structure, and ported walls, which are oriented at an angle to the exterior walls, which provide strut like reinforcement to the tubular structure. The cylindrical walls of the ports prevent the cross section of the tube from collapsing, which significantly improves the strength of the structure. This provides an opportunity to reduce the wall thickness of the bat in the hitting portion, resulting in a more resilient rebound and a more powerful bat.

The stiffness and resiliency of the ported double tube structure can be adjusted to be greater or less than a standard single hollow tube. This is because of the option of orienting the internal wall between the tubes as well as the size, shape, angle and location of the ports. The ports can be stiff if desired, or resilient allowing more deflection and recovery, or can be designed using different materials or a lay-up of different fiber angles in order to produce the desired performance characteristics of the structure.

The structure can be further refined by using more than two tubes. For example, using three tubes allows for apertures to occur in 120 degree offsets, providing specific stiffness tailoring along those directions. Using four tubes provides the possibility of having apertures at ninety degree angles to each other and alternately located along the length of the tubular part to achieve unique performance and aesthetic levels. Another option is to locate the multiple ports in the same location to achieve more of an open truss design.

Another option is to combine a single composite tube with a multiple tube composite design. In this example, the single composite tube can be a portion of the bat, for example in the handle portion, and co-molded with the multiple prepreg tubes to produce a lower cost alternative to a 100% multiple tube construction.

Alternatively, the single composite tube portion could be the hitting portion of the bat, and co-molded with the multiple prepreg tubes which form the tapered portion of the bat.

Another option is to combine the composite portion with a metal portion. In this example, the metal tube can be the hitting portion of the bat and fused or co-molded with the multiple prepreg tubes in the tapered portion to produce a lower cost alternative to a 100% carbon composite construction. This can produce a less expensive structure that can still achieve the performance and aesthetic requirements of the product.

Figure 5:
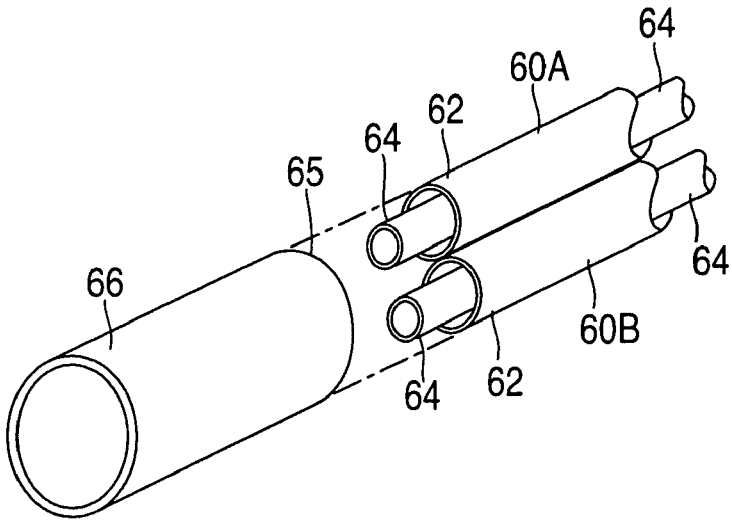
FIGS. 5-6 are perspective views illustrating a process for forming a frame member of two different materials.
Figure 6:
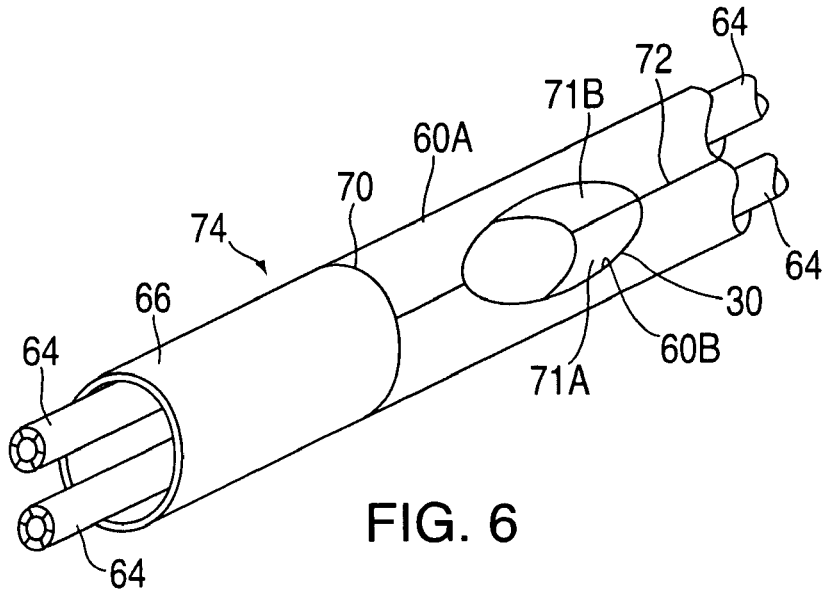

Referring to FIGS. 5-6, in order to make this construction, the forward ends 62 of a pair of prepreg tubes 60*a*, 60*b*, each having an inflatable bladder 64, are inserted into one end 65 of a metal tube 66. The unit is placed inside a mold having the same shape of the metal tube 66, at least at the juncture 70 of the prepreg tubes 60*a*, 60*b* and the metal tube 66. A pin or mold member (not shown) is placed between the prepreg tubes 60*a*, 60*b* where a port 30 is to be formed. The mold is then closed and heated, as the bladders 64 are inflated, so that the prepreg tubes assume the shape of the mold, the mold member keeping the facing walls 71*a*, 71*b* apart so as to form the port 30. As shown, the tubes 60*a*, 60*b* will form a common wall at seam 72. After the prepreg tubes have cured, the frame member 74 is removed from the mold, and the mold member or pin is removed, leaving the port 30. In this embodiment, the seam 70 between the graphite portions 60*a*, 60*b* of the frame member 74 and the metal tube portion 66 should be flush.

Yet another option is to construct a double opposing arch structure using 100% metal materials. The preferred method to produce this structure is to start with a metal tube with a "D" shaped cross section. The tube can then be formed with a half arch bend along a portion of its length. A similar operation can be done with another metal tube. The two tube halves can then be attached by fixing the flat sides of the D shaped cross section so that the two half arches oppose each other. The tubes can be welded or bonded together resulting in a structure with an internal reinforcing wall and a double opposing arch shaped aperture.

An alternative method to produce a multiple tube structure out of metal is to start with a metal tube such as aluminum, titanium, steel, or magnesium for example, and deform the tube in local areas to create dimples or craters in the surface of the tube on opposing sides. The centers of these dimples can be removed leaving a circular aperture through the tube. A tubular section can then be positioned through these circular apertures and fixed to the edges of this dimple area of the primary tube using a welding process to create the 3D structure. The result will be a structure with the primary tube being a single hollow tube with other single hollow tubes attached in a transverse manner internal to the primary tube.

The ported double tube construction can also provide more comfort to the batter. As mentioned previously, the stiffness of the tubular part can be optimized to provide greater flexibility if desired. For example the ports oriented at 90 degrees to the direction of swing to provide a more flexible zone for enhanced batter comfort.

Another advantage of the invention is the absorption of the shock wave traveling up axis of the bat. This can occur when striking the ball outside the sweet spot of the bat. Having ports along the length of the shaft which can deform and absorb this force will be an advantage.

Another advantage of the invention is vibration damping. Vibrations are damped more effectively with the opposing double arch construction. This is because the movement and displacement of the arches absorbs energy which damps vibrations. As the tubular parts deflect, the shape of the ports can change, allowing a relative movement between the portions of the tube either side of the port. This movement absorbs energy which damps vibrations.

The aerodynamic benefit provided by the ports is determined by the size of the ports relative to the diameter of the bat. In comparing the frontal area of a shaft section which is subjected to an aerodynamic force, it is possible to achieve a reduced frontal area of up to 25%. This is a significant achievement for a bat, especially considering that stiffness and strength are not compromised, but in fact improved.

Finally, there is a very distinguished appearance to a bat made according to the invention. The ports are very visible, and give the tubular part a very light weight and aerodynamic look, which is important in bat marketing. The ports can also be painted a different color, to further enhance the signature look of the technology.

There are unlimited combinations of options when considering a double opposing arch structure. The ports can vary by shape, size, location, orientation and quantity. The ports can be used to enhance stiffness, resilience, strength, comfort, aerodynamics, and aesthetics. For example in a low stress region, the size of the port can be very large in order to maximize aerodynamics and appearance. If more deflection or resilience is desired, the shape of the aperture can be very long and narrow to allow more flexibility. The ports may also use designer shapes to give the product a stronger appeal.

If more vibration damping is desired, the ports can be oriented and shaped at a particular angle, and constructed using fibers such as aramid or liquid crystal polymer. As the port deforms as a result of shaft deflection, its return to shape can be controlled with these viscoelastic materials which will increase vibration damping. Another way to increase vibration damping is to insert an elastomeric material inside the port.

Another advantage of the invention could be to facilitate the attachment to the butt cap. Having a port at the butt end of the handle provides a mechanical means of attachment of the butt cap to the handle. A similar advantage exists at the tip, if a special designed cap were to attach to the hitting portion of the bat.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A bat having a longitudinal axis; a tip end; a butt end; a handle portion extending from said butt end; a hitting portion, with a cross-section larger than said handle portion, extending from said tip and coupled to said handle portion, wherein at least a portion of said bat further comprises:

two or more hollow tubes, each tube having a length, the tubes being coextensive along at least a part of their lengths and having facing surfaces along said part, wherein portions of said facing surfaces are fused together along fused portions so as to form an integral interior wall of the shaft, and wherein said tubes have non-facing surfaces which form external surfaces of the bat, and wherein said interior wall extends from an external surface of one hollow tube through the interior of the bat to the exterior surface of another hollow tube;

wherein said facing surfaces are separated from one another at one or more locations between fused portions such that the walls of the facing surfaces at the separated locations define one or more ports which extend through the bat in a direction at least generally perpendicular to the longitudinal axis, the ports being defined by separated, facing surfaces of the tubes, wherein said ports are formed without forming holes through either tube; and wherein the facing surfaces of the two or more tubes comprise a composite material including a plurality of fiber layers, the composite material extending continuously along said fused portions and the one or more locations at which the facing surfaces are separated to form one or more ports.

2. The bat defined in claim 1, further comprising a connecting portion coupling said handle portion and said hitting portion, wherein at least one of said handle portion, said connecting portion, and said hitting portion contain said two or more hollow tubes.

3. The bat defined in claim 1, wherein said hollow tubes are composed of a composite material.

4. The bat defined in claim 2, wherein at least one of said ports is formed in said connecting portion.

5. The bat defined in claim 1, wherein said walls of said ports are shaped to form a double opposing arch structure.

6. The bat defined in claim 1, wherein said bat contains at least two of said ports which have different axial orientations with respect to the longitudinal axis of said bat.

7. The bat defined in claim 1, wherein said bat contains at least two of said ports which vary in size from one another.

8. The bat defined in claim 1, wherein said bat contains at least two of said ports which vary in shape from one another.

9. The bat defined in claim 1, wherein a portion of said bat formed of at least two hollow tubes is joined end-to-end with a portion of said bat formed of a single tube.

10. The bat defined in claim 9, wherein said portion of said bat formed of a single tube is composed of a material selected from a group comprising metal, plastic, wood, and a composite material.

11. The bat defined in claim 9, wherein said portion of said bat formed of a single tube is bonded to said portion of said bat formed of two or more tubes.

12. The bat defined in claim 1 having one or more ports having axes oriented in a first direction and one or more ports having axes oriented in a second direction.

13. The bat defined in claim 1, wherein a portion of said bat is formed of a first tube, a second tube, a third tube, and a fourth tube, each tube having two walls facing and bonded to, along portions of their length, walls of two adjacent tubes forming internal reinforcing walls which are oriented at approximately 90 degrees relative to one another.

14. A bat as defined in claim 13, wherein said walls of said first tube and said second tube are separated from the facing walls of said third tube and said fourth tube at one or more locations to form one or more ports oriented in a first direction.

15. The bat defined in claim 14, wherein said walls of said first tube and said third tube are separated from the facing walls of said second tube and said fourth tube at one or more locations to form one or more ports oriented in a second direction.

16. A bat as defined in claim 6, wherein two of said ports are located on the same portion of said bat and further wherein the axes of said two of said ports are orientated perpendicular to each other.

17. The bat defined in claim 6 wherein two of said ports are located on different portions of said bat and further wherein the axes of said two of said ports are orientated perpendicular to each other.

18. The bat defined in claim 15, wherein one of said ports oriented in said first direction and one of said ports oriented in said second direction are located at the same axial location, forming a double port generally cross-shaped, said port having four openings oriented approximately 90 degrees with respect to one another.

19. The bat defined in claim 1, wherein a portion of said bat is formed of a first tube, a second tube, and a third tube, each tube having two walls, along portions of their length, facing and bonded to walls of two adjacent tubes, forming internal reinforcing walls which are oriented at approximately 120 degrees relative to one another.

20. The bat defined in claim 19, wherein said facing walls of said first tube and said second tube, said facing walls of said second tube and said third tube, and said facing walls of said first tube and said third tube are separated from one another at the same axial location, forming a Y-shaped port having three openings whose respective axes are oriented at 120 degrees relative to one another.

21. The bat defined in claim 1, wherein along said fused portions, the facing surfaces are at least substantially flat.

* * * * *